US011000087B1

(12) United States Patent
Reynolds et al.

(10) Patent No.: US 11,000,087 B1
(45) Date of Patent: May 11, 2021

(54) ELASTIC RESISTANCE STRAP FOR USE WITH PROTECTIVE HELMETS

(71) Applicant: Blindside Partners, LLC, Lansing, NY (US)

(72) Inventors: Timothy J Reynolds, Ithaca, NY (US); John J Winslow, Lansing, NY (US); Lavell D Williams, Clinton, MS (US); James E Strait, Lansing, NY (US)

(73) Assignee: Blindside Partners LLC, Lansing, NY (US)

( * ) Notice: Subject to any disclaimer, the term of this patent is extended or adjusted under 35 U.S.C. 154(b) by 0 days.

(21) Appl. No.: 15/877,557

(22) Filed: Jan. 23, 2018

Related U.S. Application Data

(60) Provisional application No. 62/599,222, filed on Dec. 15, 2017.

(51) Int. Cl.
*A42B 3/04* (2006.01)
*A63B 23/025* (2006.01)
*A63B 21/055* (2006.01)

(52) U.S. Cl.
CPC ..... *A42B 3/0406* (2013.01); *A63B 21/0557* (2013.01); *A63B 23/025* (2013.01)

(58) Field of Classification Search
CPC ..... A42B 3/0406; A42B 3/00–328; A63B 23/025; A63B 21/0557; A63B 21/02–021; A63B 21/028; A63B 71/1291
See application file for complete search history.

(56) References Cited

U.S. PATENT DOCUMENTS

| | | | | |
|---|---|---|---|---|
| X523192 | | 7/1894 | Angle | |
| X862881 | | 8/1907 | Case | |
| 1,587,558 | A | 6/1926 | Sheffield | |
| 1,953,088 | A | 4/1934 | Purdy | |
| 1,992,904 | A | 2/1935 | Preston | |
| 2,121,973 | A * | 6/1938 | Lipton | A42B 7/00 132/58 |
| 2,453,934 | A | 11/1948 | Preston | |
| 2,507,617 | A | 5/1950 | Swendiman | |
| 2,590,951 | A | 4/1952 | Farison | |
| 3,148,375 | A * | 9/1964 | Jones | A42B 3/0473 2/421 |
| 3,497,217 | A | 2/1970 | Feather | |
| 3,571,930 | A | 3/1971 | DeWoskin | |
| 3,721,439 | A | 3/1973 | Randolph et al. | |
| 3,736,925 | A | 6/1973 | Erman | |
| 3,759,256 | A | 9/1973 | O'Malley | |
| 3,813,096 | A | 5/1974 | Welch et al. | |
| 4,195,833 | A | 4/1980 | Svendsen | |
| 4,645,198 | A * | 2/1987 | Levenston | A63B 23/025 482/10 |
| 4,650,182 | A | 3/1987 | Ross | |
| 4,666,148 | A | 5/1987 | Crawford | |
| 4,744,556 | A | 5/1988 | Shaffer | |

(Continued)

*Primary Examiner* — Andrew S Lo
(74) *Attorney, Agent, or Firm* — Randall L. Reed; Miller Mayer LLP

(57) ABSTRACT

Disclosed is an elastic exercise strap with a gripping portion that merges into a loop or aperture. The strap can be connected to a sports helmet by threading the extended gripping portion around a part the helmet and then inserted through the loop or aperture. By pulling on the attached strap the neck muscles can be exercised.

18 Claims, 7 Drawing Sheets

(56) References Cited

U.S. PATENT DOCUMENTS 4,832,333 A * 5/1989 Lockett ..... A63B 23/025 482/10
4,909,502 A 3/1990 Beuwakes, III et al.
5,129,106 A 7/1992 Liou
5,162,027 A 11/1992 Robinson
5,336,139 A 8/1994 Miller
5,372,565 A * 12/1994 Burdenko ..... A63B 21/0552 482/124
5,431,610 A 7/1995 Miller
5,484,359 A 1/1996 Wabafiyebazu
5,501,646 A 3/1996 Miller
5,505,677 A * 4/1996 Hinds ..... A63B 21/0004 482/10
5,507,707 A 4/1996 Miller
5,509,869 A 4/1996 Miller
5,556,357 A 9/1996 Hanna
5,577,983 A 11/1996 Fraser
5,662,554 A * 9/1997 Schaefer ..... A63B 23/025 119/833
5,681,248 A * 10/1997 Vani ..... A63B 21/0004 482/10
5,915,541 A * 6/1999 Beltrani ..... B63C 11/12 2/430
6,036,625 A 3/2000 Woodruff
6,110,080 A 8/2000 Niv
D438,577 S * 3/2001 Phillips ..... D21/662
6,446,272 B1 * 9/2002 Lee ..... A63B 33/002 2/428
7,390,286 B1 * 6/2008 Edgeton ..... A63B 21/055 482/10
7,901,327 B2 3/2011 Hargis et al.
7,975,318 B2 7/2011 Zuber
8,012,071 B2 9/2011 Grisdale
8,308,616 B1 11/2012 Flavell
8,613,690 B1 * 12/2013 Thompson ..... A63B 23/025 482/10
8,721,507 B2 5/2014 Blancher
8,819,867 B1 9/2014 Boada
8,840,528 B2 9/2014 Zylistra
9,017,235 B2 4/2015 Khademi
9,204,987 B1 * 12/2015 Breibart ..... A61F 5/055
9,498,675 B2 11/2016 Walworth
9,526,965 B2 12/2016 Gatherer
9,962,575 B2 * 5/2018 Askins ..... A63B 23/025
10,388,180 B1 * 8/2019 Dayan ..... A63B 21/02
2001/0035440 A1 * 11/2001 Danielson ..... A45F 5/02 224/149
2004/0058780 A1 * 3/2004 Edgeton ..... A63B 21/055 482/10
2004/0220445 A1 * 11/2004 Bove ..... A61N 2/06 600/9
2005/0043154 A1 * 2/2005 Atrizadeh ..... A63B 21/0004 482/124
2008/0274858 A1 11/2008 Flavell et al.
2011/0263931 A1 * 10/2011 Nowlin ..... A61F 2/0045 600/37
2011/0306477 A1 * 12/2011 Keen ..... A63B 21/02 482/122
2012/0096632 A1 * 4/2012 Chou ..... A63B 33/002 2/452
2012/0102631 A1 * 5/2012 Lee ..... A43C 11/12 2/431
2012/0165169 A1 6/2012 Gahterer
2013/0000680 A1 * 1/2013 Azelton ..... E03C 1/302 134/22.11
2013/0009032 A1 * 1/2013 Polletta ..... F16M 11/041 248/440.1
2014/0096313 A1 * 4/2014 Waller ..... B63C 11/12 2/452
2014/0128225 A1 * 5/2014 Weck ..... A63B 71/14 482/44
2014/0274601 A1 * 9/2014 Crowell ..... A63B 21/0555 482/121
2014/0310857 A1 * 10/2014 Lastik ..... A42B 3/08 2/421
2014/0325747 A1 * 11/2014 Gwen ..... E03C 1/302 4/255.01
2015/0202514 A1 * 7/2015 Ervin ..... A63B 69/0071 473/450
2015/0251040 A1 * 9/2015 Pinder ..... A63B 21/0407 482/124
2016/0058270 A1 * 3/2016 Seitz, III ..... A61M 25/002 206/363
2016/0067752 A1 * 3/2016 Dennis ..... B08B 9/0436 4/255.01
2016/0287935 A1 10/2016 Sykes
2017/0151459 A1 * 6/2017 Abramovich ..... A63B 21/0555
2017/0248193 A1 * 8/2017 Marvan ..... A63B 71/0054
2019/0111303 A1 * 4/2019 Aihara ..... A63B 21/02

* cited by examiner

ELASTIC RESISTANCE STRAP FOR USE WITH PROTECTIVE HELMETS

CROSS-REFERENCE TO RELATED APPLICATIONS

This application claims under applicable United States Law the benefit of priority under of U.S. Provisional Application Ser. No. 62/599,222 filed on Dec. 15, 2017 the content of which is relied upon and incorporated herein by reference in its entirety.

TECHNICAL FIELD

The present disclosure is in the field of resistance exercise straps and bands. More particularly, this application relates to the use of elastic straps for training and strengthening purposes with protective helmets.

BACKGROUND

Sports injuries have always been of serious concern. Attempts to prevent them have been numerous. Proper conditioning and training of athletes at the beginning of participation in a sport and during the athletes' involvement in that sport has provided one of the key and most important means for preventing sports injuries. Contact sports such as football, hockey, and lacrosse have an especially important need for proper training and conditioning. The athletes' muscle strength and flexibility training can provide all the difference in preventing injuries.

One area of the athlete s anatomy of particular concern is the neck, the injury of which can cause serious tong-term health problems, if not paralysis and death. Although, the standard exercises for a sport, running, calisthenics, and the preparatory exercises can easily strengthen arm, leg, back and torso muscles, most of these exercises do not provide the necessary training and strengthening of the neck muscles.

The attempts to provide a means for strengthening and conditioning neck muscles have been numerous. In fact the USPTO has issued a plethora of patents invented for this purpose. U.S. Pat. No. 6,036,625 is an example of a device designed to exercise various muscle groups of a person's body by doing with an elastic strap. In one variation one end of the elastic strap mechanism is attached to a fixed object such as doorway and an opposite end has a harness that the person puts over their head to exercise neck muscles. U.S. Pat. Nos. 8,840,528 and 9,526,965 and US patent application 2016/0287935 also provide elastic strap for doing exercises where one end or portion of the strapping system is connected to fixed object and an opposing end is attached to a harness that fits over the person's head or around their neck to perform the exercises. However, all of these devices require a fix object adjacent to the person using the device in order to do the exercise. None provide an easy and efficient way for someone to do neck exercises without such a fixed object such as a wall or doorway.

U.S. Pat. No. 9,498,675 discloses a helmet that has a weighted flexible rod attached to it to allow the wearer of the helmet to exercise neck muscles. U.S. Pat. No. 8,613,690 discloses a neck therapy device that includes a head piece with straps extending down from the head piece that allow a person wearing the head piece to modulate neck movement or pull on the straps can be used exercise neck muscles.

While these systems provide one means for, a person to exercise his or her neck muscles they are limited in their functionality and fail to meet a board need for one to perform neck exercises under many different conditions. Specifically, an easy and simple apparatus that will allow a person wearing a sports protective helmet to exercise the wearers neck muscles.

No admission is made that any reference cited herein constitutes prior art. Applicant expressly reserves the right to challenge the accuracy and pertinence of any cited documents.

SUMMARY

An aspect of the present, subject matter is directed towards an elastic resistance strap comprising: a linear portion that may merge into a looped portion that would, allow for the linear portion to pass through; a series of at least one raised projections, or other form of distinguishable marking, on the surface of the strap. The strap may be of various thicknesses and Lengths.

Another aspect of the present subject matter is directed towards an elastic resistance band comprising: a Looped elastic band; a series of at Least one, raised projections, or other form of distinguishable marking, on the surface of the band. The band may be of various thicknesses and lengths.

A further aspect of the present subject matter is directed towards an elastic resistance band comprising: a linear portion that may merge into a Looped portion at either end of the aforementioned Linear portion that would allow for one loop to be passed through the other; a series of at least one raised projections, or other form of distinguishable marking, on the surface of the strap. The band may be of various thicknesses and/or lengths.

An additional aspect of the present subject matter is directed towards an elastic resistance strap and comprising: a linear portion that may contain a slit at either end of the aforementioned Linear portion that would allow for one end of the band to be passed through the slit. The strap may be of various thicknesses and/or lengths.

To accomplish the objectives of the present invention it provides a device for exercising neck muscles having: a) an elastic strap; b) the strap having an aperture at a first end; c) the strap having a Length for gripping extending from the first end to a second end; d) the second end can be inserted into the aperture to thereby allow the elastic strap to connect to a portion of a helmet; and f) wherein a person wearing a helmet can connect the elastic strap to the helmet and exercise neck muscles by pulling on the length for gripping while wearing the helmet. In a further aspect the one aperture is, a closed loop at the first end of the strap. In another aspect of the invention the one aperture are closed loops at the first end and at the second end of the elastic strap. In another aspect of the invention the one aperture is formed by the elastic strap being one continuous band and the first end and the second end meeting to form a closed continuous strap. In another aspect of the invention the length for gripping has at least one tactile-visual marker. In yet another aspect of the invention the at Least one tactile-visual markers is a plurality of tactile-visual markers. The elastic strap can be made of materials such as: polyurethanes, rubber, and silicone.

In another variation of the invention it provides an article of manufacture, that is a training aid for strengthening neck muscles having: a) an elastic strap with (i) at least one aperture at a first end; and (ii) a length for gripping extending from the first end to a second end; b) together with labeling: (I) Instructions that the length for gripping should be put around a portion of a helmet and then the second end inserted into at least one aperture at the first end to thereby connected the elastic strap to the helmet; and (II) Instructions to grasping the length for gripping and pull on the length for gripping to exercise neck muscles of a person wearing the helmet. In a variation of the invention it includes further instructions that it can be used with any type of helmet including but not limited to: a football helmet, a hockey helmet or a lacrosse helmet.

In another aspect of the invention it provides a method for exercising neck muscles while wearing a helmet comprising the steps of: (a) providing an elastic strap having: (i) at least one aperture; and (ii) a Length for gripping that can be inserted into the aperture; and (b) looping the length for gripping over a portion of a helmet to thereby connect it the helmet; and (c) a person grasping the length for gripping while the helmet is on a person to exercise the neck muscles of the person wearing the helmet and pulling the strap.

In yet another variation of the invention it provides an elastic resistance strap comprising: a linear portion that merges into at least one loop at a first end of the strap, wherein the linear portion can be draped around a portion of a helmet and inserted through the at least one loop to detachably connect the elastic resistance strap to the helmet. In a further aspect the strap includes visual and tactile markers on the linear portion to allow a person pulling on the strap to gauge the amount of stretching of the strap when it is being pulled.

In yet another variation of the invention it provides an article of manufacture having: (a) An elastic strap that forms a closed loop with a large center aperture; (b) together with labeling instructions: (i) that the strap should be put around a portion of a helmet and then a portion of the strap inserted into the aperture to thereby connected the elastic strap to the helmet; (ii) that the strap should be drawn tight so that the portion inserted through the aperture forms a length for gripping; and (iii) to grasp the length for gripping and pulling on the length for gripping to exercise neck muscles of a person wearing the helmet.

Additional features and advantages will be set forth in the detailed description which follows, and in part will be readily apparent to those skilled in the art from the description or recognized by practicing the embodiments as described in the written description and claims hereof, as well as the appended drawings:

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Figure 2:
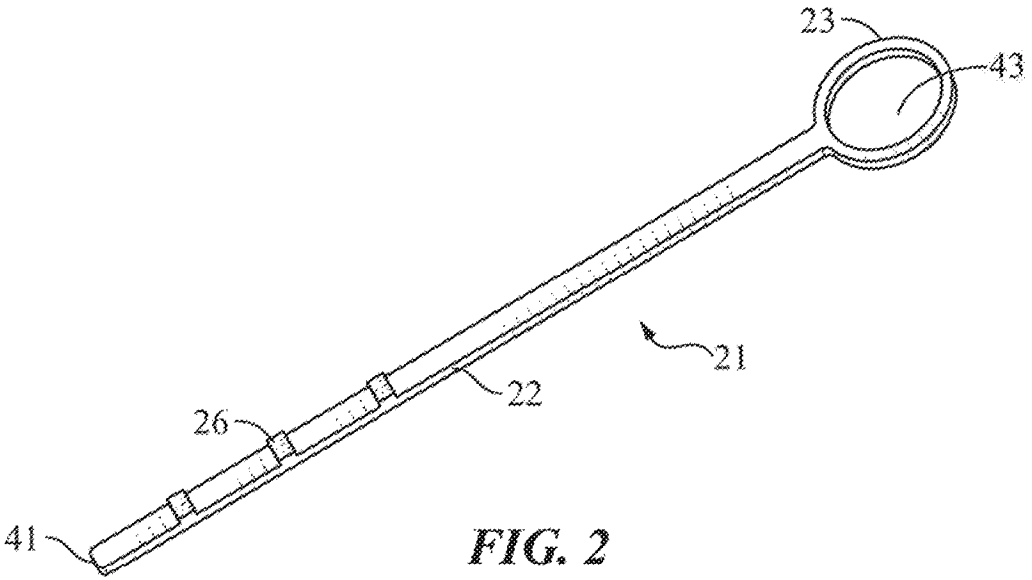
FIG. 2 is a an oblique view of the embodiment of the elastic resistance strap depicted in FIG. 1.

Reference is now made in detail to the description of non-limiting embodiments as illustrated in the drawings. While the embodiments described may use specific materials or configurations, there is no intent to limit the subject matter to the embodiment or embodiments disclosed herein. Accordingly, various modifications to the embodiments presented may be readily apparent to those skilled in the art, and the generic principles described herein can be applied to other non-limiting embodiments without departing from the spirit or scope of the claimed subject matter. As such, this detailed description of various alternative embodiments should not be construed to limit the scope or breadth of the present apparatus, system and method as set forth in the claims.

Figure 3:
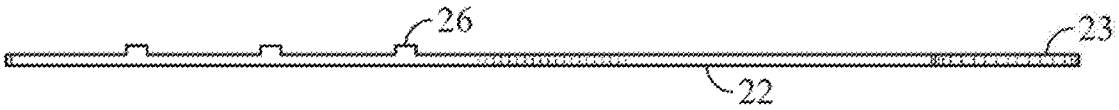
FIG. 3 is a side view of the embodiment of the elastic resistance strap depicted in FIG. 1.
Figure 1:
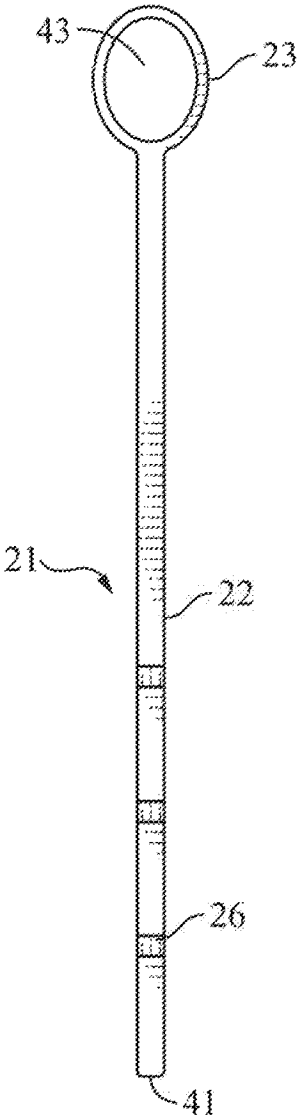
FIG. 1 is a front view of an embodiment of elastic resistance strap of the present invention.

FIGS. 1, 2 and 3 provide various views of one embodiment of the elastic resistance strap 21 of the present invention. FIG. 1 is a front view, FIG. 2 is an oblique view and FIG. 3 is a side view of an elastic resistance strap 21. As can be seen in FIG. 1, the elastic resistance strap has a linear portion 22 which merges into a loop or aperture portion 23. Loop portion 23 forms aperture 43. Raised projections 26 are on linear portion 22 of strap 21.

Elastic resistance strap or band 21 can be made from a variety of flexible materials including rubber, pure gum rubber synthetic polymers, silicone, polyurethanes or any similar material that can endure strenuous and continuous stretching yet retain its original shape when not under tension. The Linear portion 22 must be Long enough for a person to firmly grasp it to stretch it when attached to a helmet as will be discussed below. In one variation linear portion has a sufficient thickness and length that it forms a handle that can be grasped by one's hand. In another variation it is thin but has sufficient length that it can be wrapped one or more times around a person's hand and securely grasped. Loop portion 23 must be large enough to allow the end of 41 to pass through Loop 23 when strap 21 is attached to a helmet. Alternatively, it must provide an expandable aperture to allow linear portion to be inserted through the loop.

Figure 4:
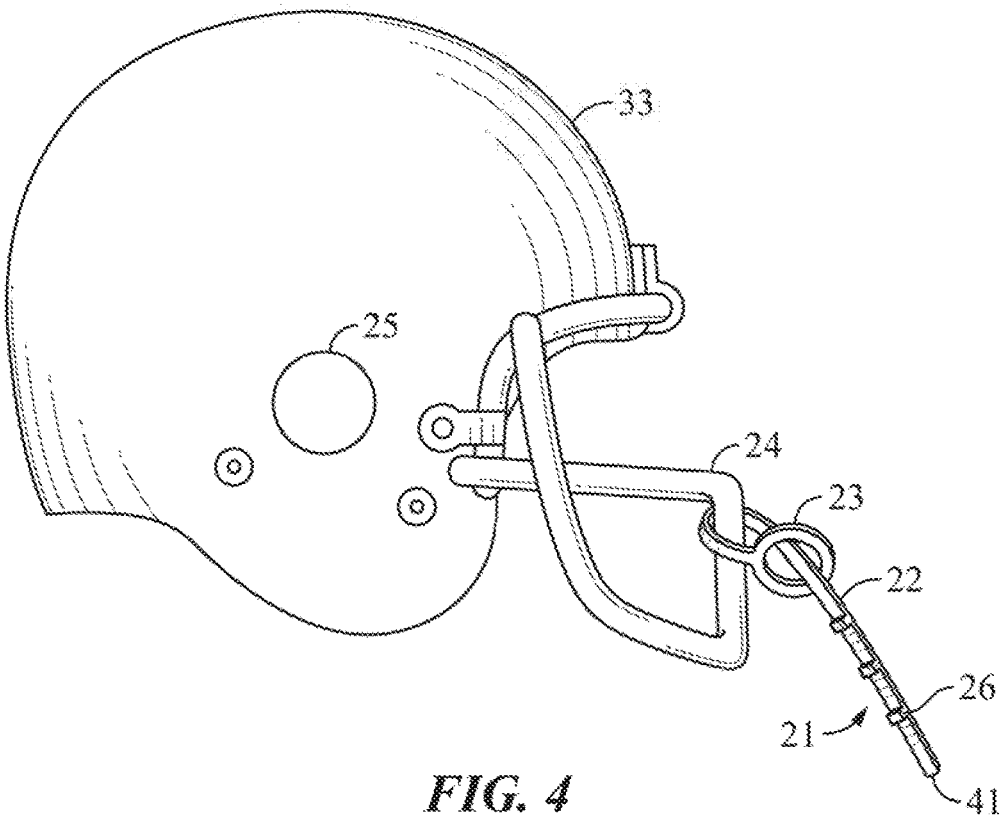
FIG. 4 is a side view of a football helmet with the embodiment of the elastic resistance strap depicted in FIG. 1 attached to the facemask.

FIG. 4 is side view of a football helmet 33 to which strap 21 has been attached to face mask 24. As can be seen Linear portion 22 is threaded around face mask 24 and then inserted through Loop 23 to detachably but securely connect elastic strap 21 to face mask 24. When helmet 33 is on the head of an individual (not shown here) who wants to exercise his or her neck muscles, they can grab linear portion 22 by using their hand while resisting with their neck muscles to perform a series of neck exercises. Raised portions 26 on linear portion 22 can then be used as a visual or tactile gauge as to how far they pull the flexible strap and thus the amount of tension they are generating with each isometric exercise.

Figure 5:
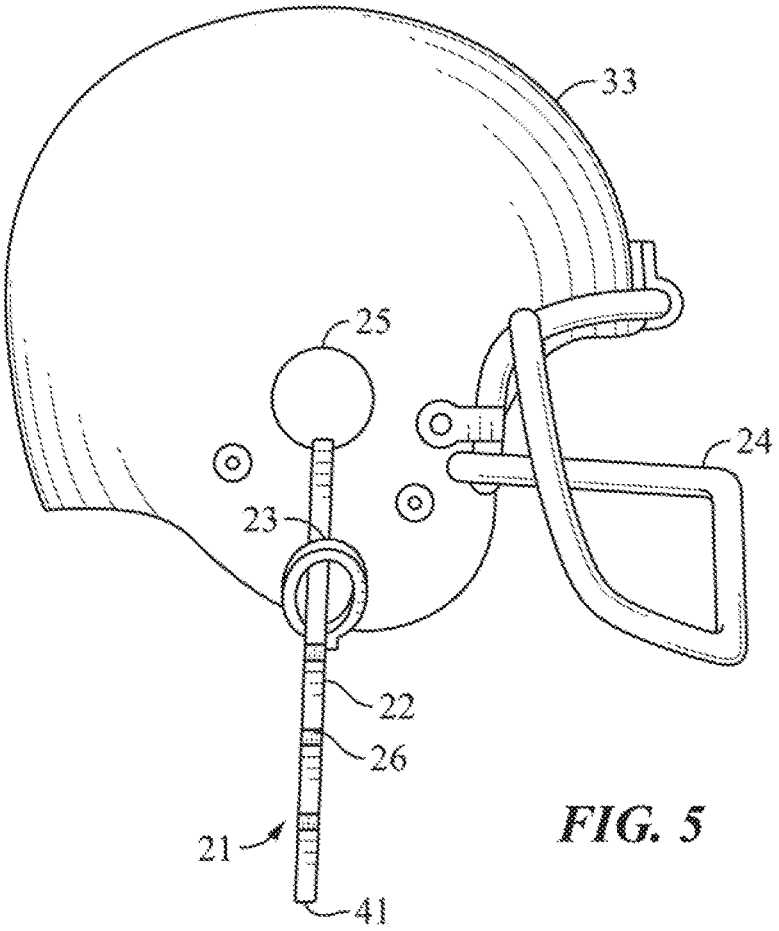
FIG. 5 is a side view of a football helmet with the embodiment of the elastic resistance strap depicted in FIG. 1 attached to the helmet at its ear hole.

FIG. 5 provides a view of helmet 33 with elastic exercise strap 21 connected to helmet 33 at ear hole or aperture 25. Here again linear portion 22 is inserted around the helmet through ear aperture 25 and then through aperture 43 formed by loop 23. Isometric neck exercises then can be performed by a person wearing the helmet by grasping linear portion 22 and resisting with the neck muscles the force generated by pulling linear portion 22. Although the examples of use of the elastic resistance strap depicted in the description of the invention are with a football helmet, the resistance strap can just as easily be used with other sports helmets for neck exercises. This would include ice hockey helmets, lacrosse helmets, etc. As described herein the invention provides a training system for strengthening neck muscles. As a training system labelling can be included with the apparatus instructing its use with a helmet to exercise neck muscles. This would include football, lacrosse and hockey helmets.

Alternatively, it must provide an expandable aperture to allow linear portion to be inserted through the loop.

Figure 6:
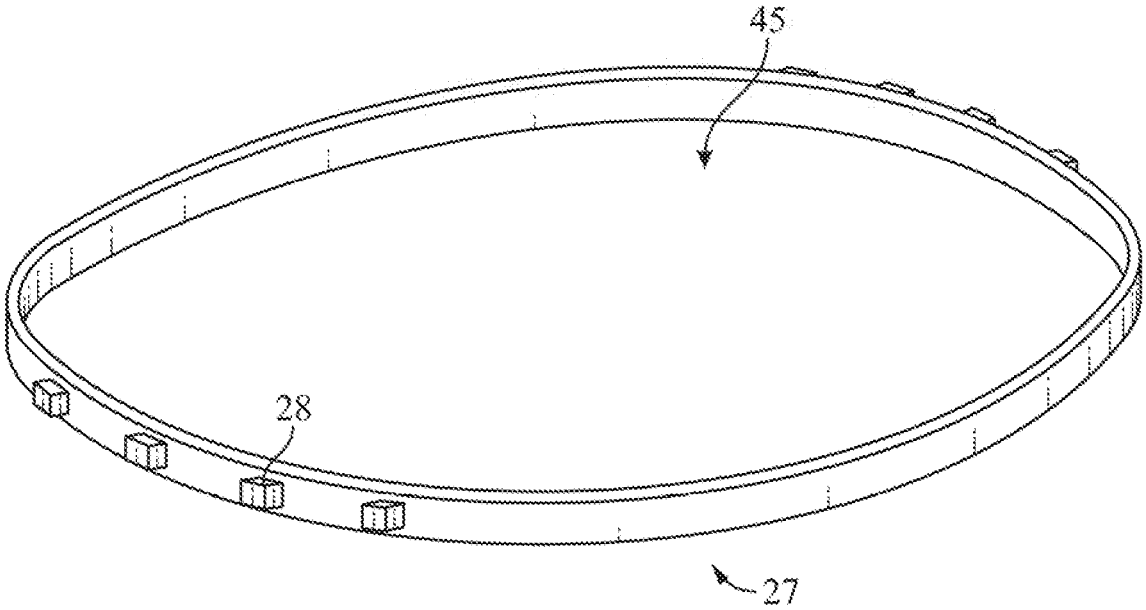
FIG. 6 is a perspective view of an alternative embodiment of the elastic resistance strap of the present invention.

FIG. 6 is a perspective view of a second embodiment of elastic resistance strap 27 of the present invention. Elastic resistance strap 27 is a continuous hoop or Loop that forms a Large aperture 45. Strap 27 is made of a flexible but resilient material including but not limited to rubber, synthetic polymers, silicon, polyurethanes or any similar material that can endure strenuous stretching but maintain its elasticity and resilience. Strap 27 has raised projections 28 on its surface.

Figure 7:
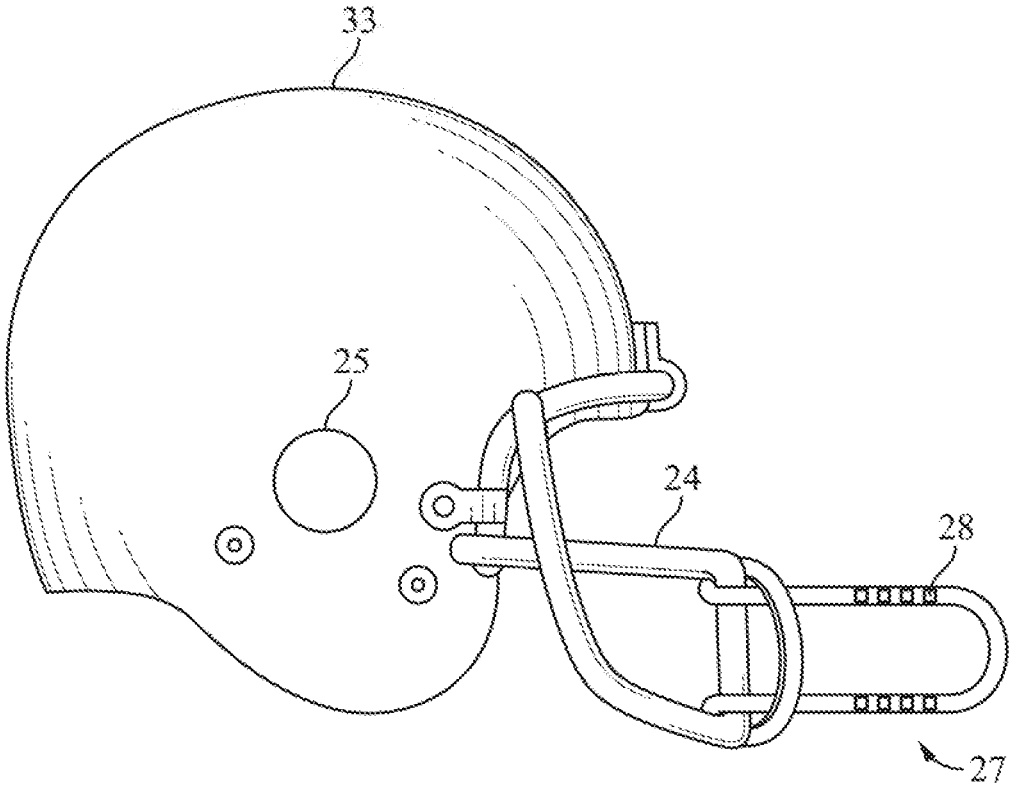
FIG. 7 is a side view of a football helmet with the elastic resistance strap of FIG. 6 attached to the face mask.

FIG. 7 is a side view of a protective helmet, in this case a football helmet, with elastic resistance strap 27 connected to face mask 24. As can be seen, a portion of elastic band 27 which forms a continuously closed loop is passed through itself to detachably connect to face guard 24. Raised projections 28 are on the portion of closed loop band 27 that projects out from the helmet and forms the portion of band 27 that will be gripped by the person wearing the helmet to perform the exercises.

Figure 8:
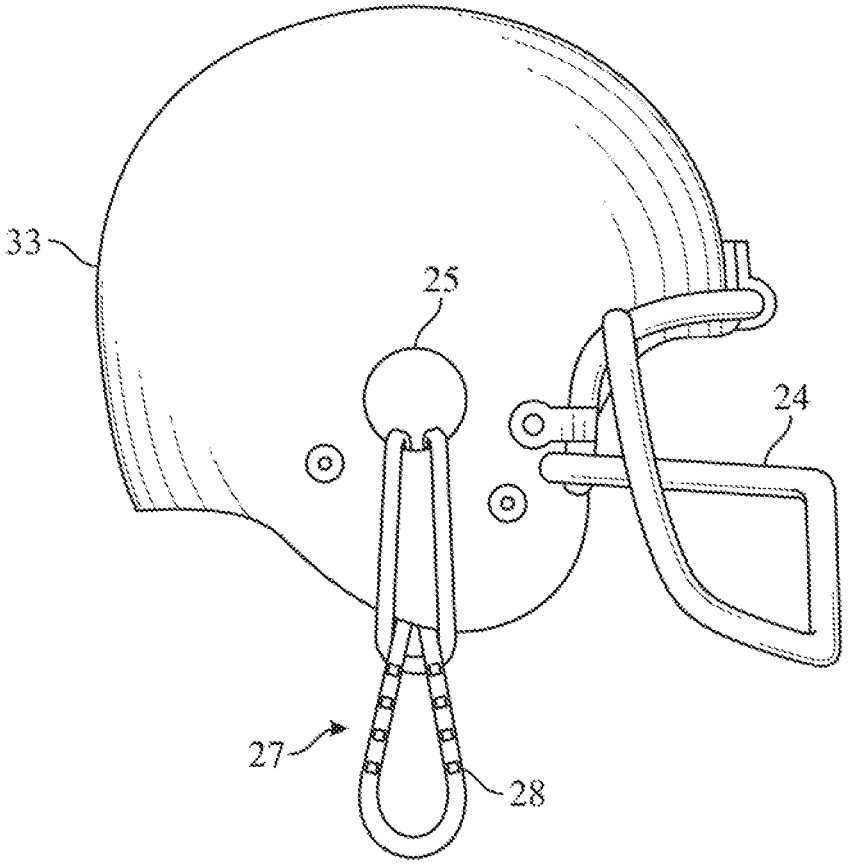
FIG. 8 is a side view of a football helmet with the embodiment of elastic resistance strap depicted in FIG. 6.

FIG. 8 is a side view of protective helmet 33 with elastic band 27 detachably looping through ear hole 25. As previously noted, a portion of elastic loop band 27 is threaded through ear hole 25 and then it passes through aperture 45 to detachably connect it to the helmet. Thus, when conducting exercises while strap 27 is connected to face mask 24, the wearer of the helmet (not shown here) would grasp strap 27 with their hand and pull using their neck muscles to oppose the force created by pulling strap 27. Projections 28 on strap 27 provide a tactile and visual indication of the amount of flexion of band 27 and thus an indication of the force generated by pulling on the strap. Likewise when strap 27 is connected via ear hole 25 as depicted in FIG. 8 the same technique is used to perform the exercises.

Figure 10:
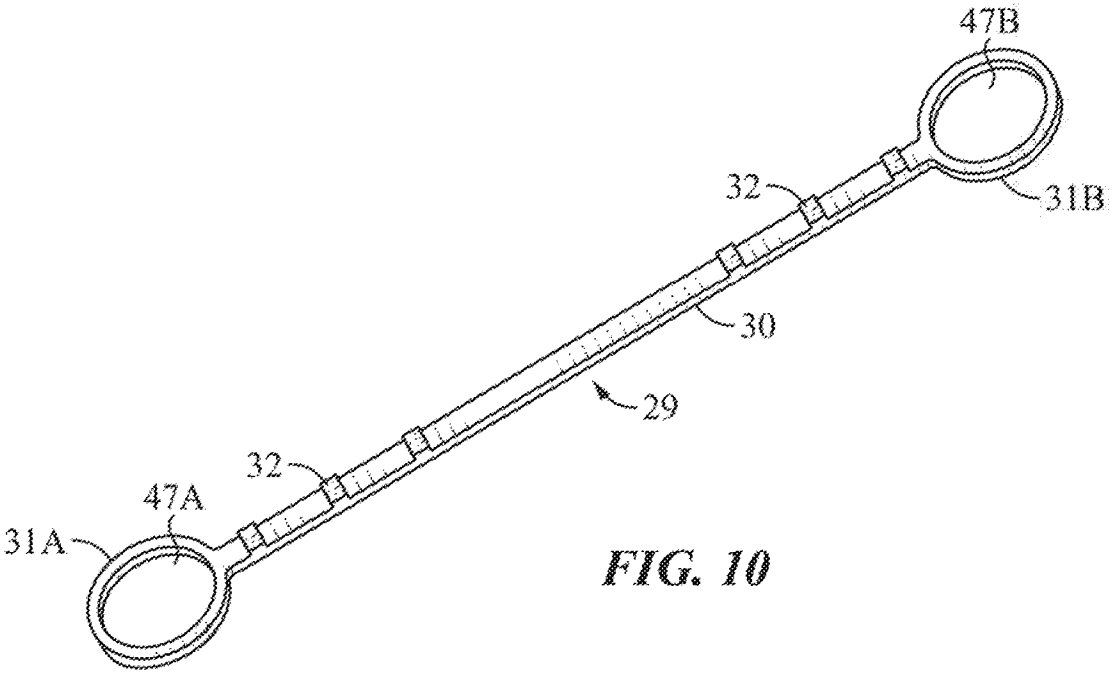
FIG. 10 is an oblique view of the embodiment of the elastic resistance strap depicted in FIG. 9.
Figure 11:
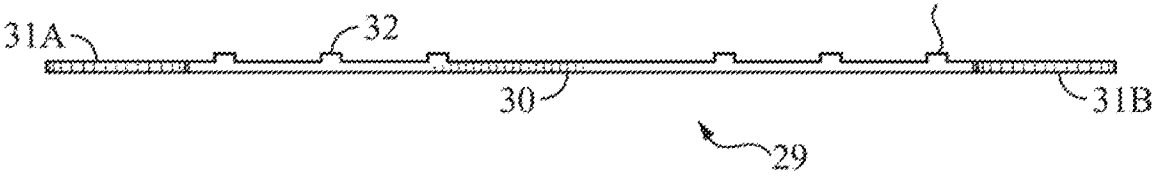
FIG. 11 is a side view of the embodiment of the elastic resistance strap depicted in FIG. 9.
Figure 9:
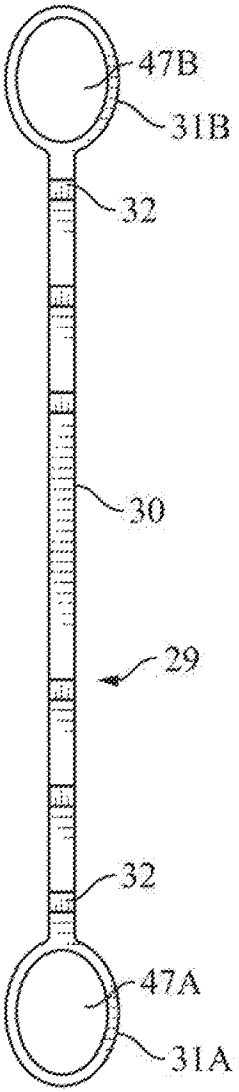
FIG. 9 is a front view of a third embodiment of the elastic resistance strap of the present invention.

FIG. 9 is a front view of a third embodiment 29 of the elastic resistance strap of the present invention. This embodiment of the invention strap 29 has a center linear portion 30 that terminates in two closed Loops 31A and 31B at a first and second end of center linear portion 30. Loop 31A forms aperture 47A and loop 31B forms aperture 47B. Projections 32 are also on the front of linear portion 30 of strap 29. FIG. 10 provides an oblique view of strap 29 on which Loop 31A and 31B can be seen. FIG. 11 is a side view of strap 29.

Figure 12:
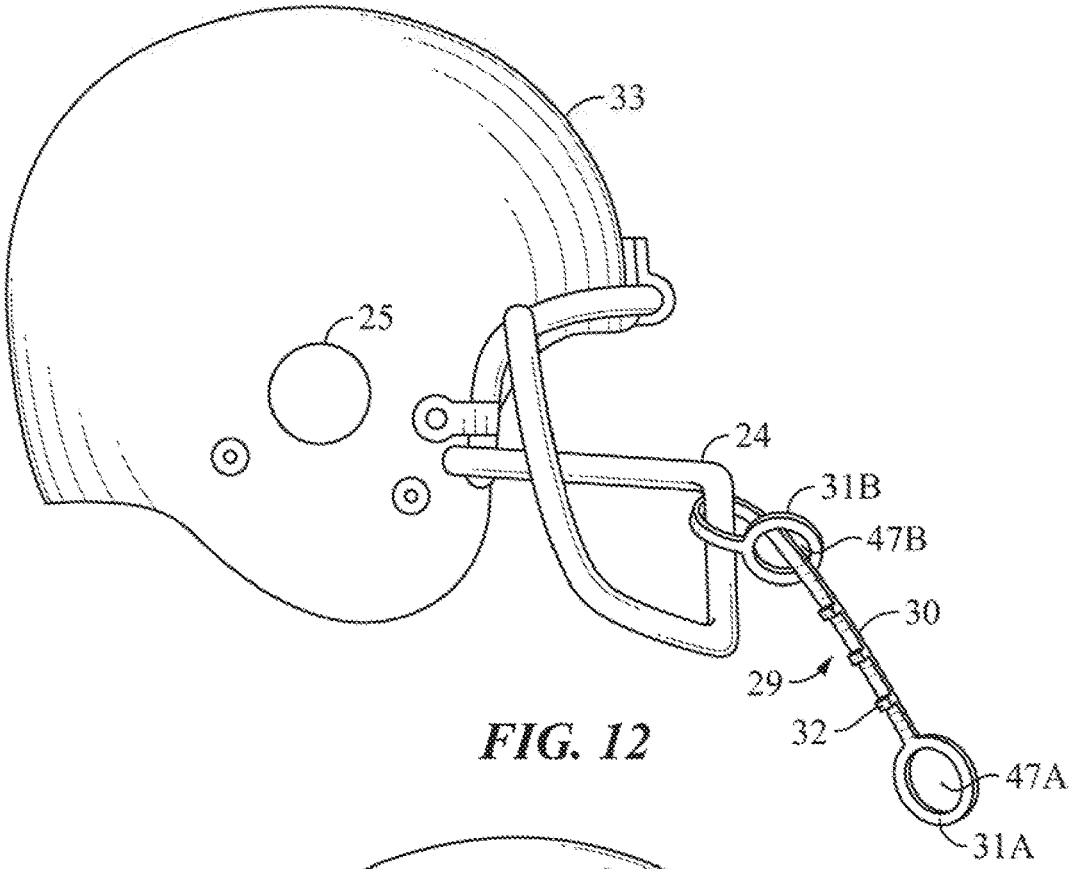
FIG. 12 is a side view of a football helmet with the embodiment the elastic resistance strap depicted in FIG. 9 attached to the face mask.
Figure 13:
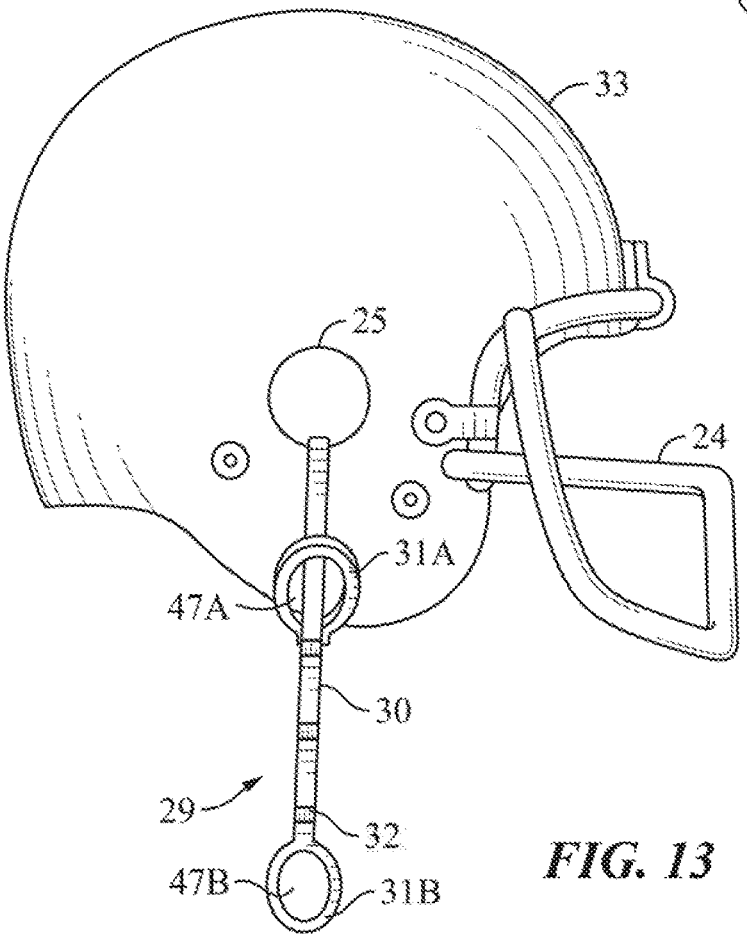
FIG. 13 is a side view of a football helmet with the embodiment of the elastic resistance strap depicted in FIG. 9 attached to the helmet through the ear hole.

FIG. 12 is a side view of protective helmet 33 which has strap 29 detachably connected to faceguard 24. Strap 29 is connected by wrapping linear portion 30 around face mask 24 and inserting loop end 31A through loop end 319. Obviously this could be reversed and loop end 31B could be inserted through loop end 31B FIG. 13 is of protective helmet 33 with strap 29 detachably connected by inserting loop end 31B through ear hole 25 and wrapping linear portion 30 around the adjacent section of protective helmet 33 and inserting Loop end 31B through 31A. The exercise can be conducted by a person (not shown here) wearing helmet 33 by grasping strap 29 and putting in the same fashion as described with the other embodiments of the elastic resistance band.

Figure 14:
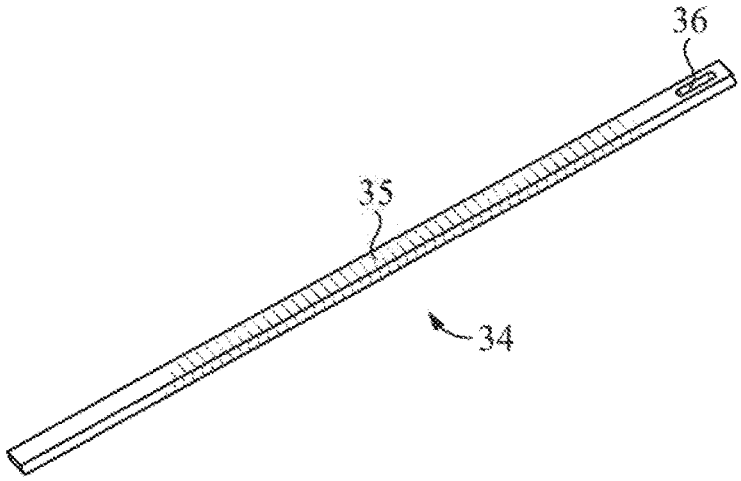
FIG. 14 is a front view a fourth embodiment of the elastic resistance strap of the present invention.

FIG. 14 is a front view of a fourth embodiment 34 of the elastic resistance band of the present invention. This embodiment of the elastic resistance strap 34 has a small aperture or slit 36 at one end of strap 34 with a tong narrow linear or gripping portion 35.

Figure 15:
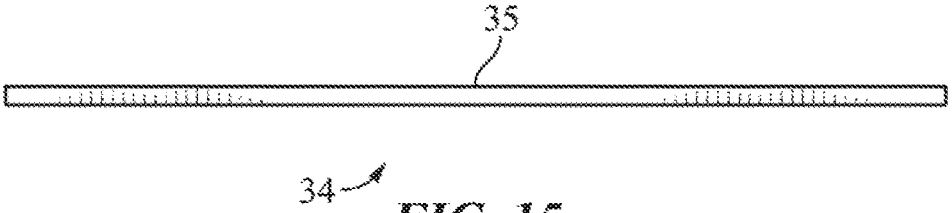
FIG. 15 is a side view of the embodiment of the elastic resistance strap of the present invention.

FIG. 15 is a side view of resistance strap 34. Referring back to FIG. 14, although aperture 36 appears to be and is smaller than the thickness of strap 34, since strap 34 consists of a highly flexible and resilient material aperture 36 expands to accommodate the tong narrow gripping portion. Strap 34 would be connected to a sports helmet in the same fashion as the previously described embodiments are connected.

Figure 16:
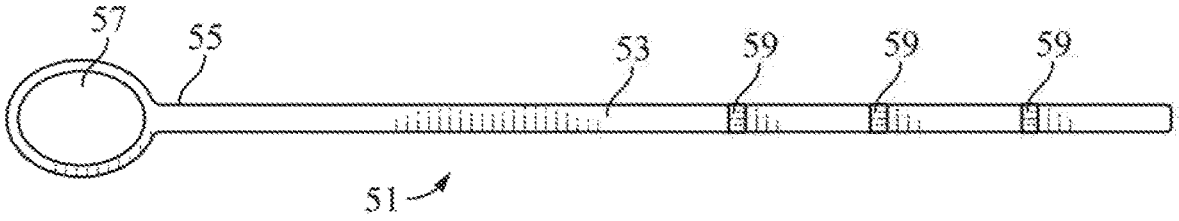
FIG. 16 is a front view of a fifth embodiment of the elastic resistance strap of the present invention.

FIG. 16 is a front view of a fifth embodiment 51 of the elastic resistance band. Band 51 has an extended linear portion 53 that terminates, in Loop 55. Loop 55 forms aperture 57. Tactile visual markers 59 are on linear portion 53. In this variation the length from the loop 55 and including loop 55 is about 35 cm or approximately 14 inches. Since loop 55 is 5 cm or 2 inches on it elongated length the linear portion 53 is 11 inches long. In this variation although linear portion 53 is quite thin it can be wound around a person's hand and securely held to conduct resistance exercises. Naturally it can be made of the same types flexible and resilient materials as discussed elsewhere in this specification.

As noted above the elastic resistance strap of the present invention as presented in its various embodiments above consists of a strong, resilient and flexible material. While the material must be flexible enough to be pulled and thus stretched without breaking, at the same time it must offer sufficient resistance for the desired isometric exercise effect of the athletes' neck muscles. Such materials as noted above include including rubber, synthetic polymers, silicone, polyurethane and similar materials.

In one variation of the invention specific specifications for such flexible and strong material that makes up the elastic resistance strap would include: 1) tensile strength (psi): >500 psi, 2) hardness: Durometer-Shore "A" hardness of: 30 to 45, and 3) an elongation (%) of more than 300%. A prototype of the elastic resistance band has: a) a hardness of 30 Shore "A"; b) a tensile Strength of 500 psi and a cross section of approximately 0.25 in ^2 so, at 500 pounds per square inch that can handle 125 pounds without breaking; and c) an elongation of 364%. However, the above is merely provided to give some context of the makeup of various embodiments of the invention and those skilled in the art once they understand the precepts on parameters of the invention wilt understand that these specifications can be significantly varied without departing from the spirit and concepts of the invention.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

We claim:

1. A system for exercising neck muscles comprising: a protective helmet; an elastic resistance strap; said strap having at least one aperture at a first end; said strap having a bngth for gripping by hand, extending from said first end to a second end; said second end is configured to be inserted into said aperture to thereby allow said resistance strap to connect to a portion of said helmet; wherein said length for gripping has at least one raised projection; and wherein said strap is configured to exercise neck muscles by a user pulling on said bngth for gripping while wearing said helmet.

2. The system of claim 1 wherein said at least one aperture is a closed loop at said first end of said resistance strap.

3. The system of claim 1 wherein said at least one raised projection is a plurality of raised projections.

4. The system of claim 1 wherein said elastic resistance strap is made of material selected from a group consisting of: polyurethanes, rubber, and silicone.

5. The training system of claim 1 wherein said at least one aperture is a closed loop at said first end of said resistance strap and a closed loop at said second end of said resistance strap at a second end.

6. A sytem for exercising neck muscles comprising: a protective helmet and an elastic resistance strap a linear portion of said strap for gripping by hand that merges into at least one loop at a first end of said strap, said linear portion having raised projections on said linear portion to allow a person pulling on said strap to gauge the amount of stretching of said strap when it is being pulled, to thereby gauge tension tactilely, and wherein said linear portion is configured to be draped around a portion of a helmet and inserted through said at least one loop to detachably connect said elastic resistance strap to the helmet.

7. A device for exercising neck muscles comprising:

a. an elastic resistance strap;

b. said strap having at least one aperture at a first end;

c. said strap having a length for gripping by hand, extending from said first end to a second end;

d. said second end is configured to be inserted into said aperture to thereby allow said resistance strap to connect to a portion of a helmet;

e. wherein said length for gripping has at least one tactile marker;

f. wherein said device is configured to exercise neck muscles by a user pulling on said length for gripping white wearing the helmet; and g. wherein said at least one aperture are closed bops at said first end and at said second end of said elastic strap.

8. The system of claim 7 wherein said tactile marker is plurality of raised portions.

9. A training system for exercising neck muscles comprising:

a. an elastic resistance strap having:

i. at least one aperture at a first end of said strap;

ii. a length for gripping extending from said first end to a second end of said strap;

iii. at least one raised projection on said length for gripping;

together with labeling comprising:

i. instructios that said lenth for gripping should be put around a portion of a helmet and then said second end inserted into at least one aperture at said first end to thereby connected said resistance strap to the helmet; and ii. instructions to grasp said length for gripping and pull on said length for gripping to exercise neck muscles of a person wearing the helmet; and a protective helmet to connect said resistance strap thereto, to thereby exercise said neck muscles, when said helmet is worn on a person using said resistance strap.

10. The training system of claim 9 wherein said at least one aperture is a closed loop at said first end of said resistance strap.

11. The training system of claim 9 wherein said at least one raised projection is a plurality of raised projections.

12. The training system of claim 11 including an additional instruction that said plurality of raised projections are used to gauge a force generated by pullilng on said resistance strap.

13. The training system of claim 9 wherein said elastic resistance strap is made of material selected from a group consisting of: polyurethane, rubber, pure gum rubber and silicone.

14. The training system of claim 9 including an additional instruction that said resistance strap can be used with a football helmet, a hockey helmet and a lacrosse helmet.

15. The training system of claim 9 wherein said at least one aperture is a closed loop at a said first end of said strap and a closed loop at said second end of said elastic strap.

16. A method for exercising neck muscles while wearing a helmet comprising the steps of:

a. providing an elastic resistance strap having:

i. at least one aperture;

ii. a length for gripping that can be inserted into said aperture; and iii. at least one raised projection on the length for gripping:

b. looping said length for gripping over a portion of a helmet through the aperture to thereby connect the resistance strap to the helmet; and c. grasping said length for gripping while the helmet is worn on the person's head to exercise the neck muscles by pulling the resistance strap.

17. The method of claim 16 including the step of determining the amount of tension being generated by pulling on the resistance strap by the at least one raised projection on the linear portion of the resistance strap.

18. The method of claim 16 wherein the step of providing at least one raised projection on the length for gripping-comprises providing a plurality of raised projections, and the additional step of gauging the amount of tension being generated by pulling on the length for gripping with the tactile markers.

* * * * *